US005265626A

United States Patent [19]

Schneider et al.

[11] Patent Number: 5,265,626

[45] Date of Patent: Nov. 30, 1993

[54] COAXIAL FILTER CIGARETTE

[75] Inventors: Werner Schneider, Quickborn; Horst Borowski, Hamburg; Erwin Kausch; Rolf Kütting, both of Jesteburg; Meinhard Meyer, Appen-Unterglinde; Knut Möller, Hamburg; Bernd-Henrik Müller, Hamburg; Erhard Rittershaus, Hamburg; Gert Rudolph, Hamburg; Adolf Schlüter, Quickborn; Wolfgang Wiethaup, Hamburg, all of Fed. Rep. of Germany

[73] Assignee: B.A.T. Cigarettenfabriken GmbH, Hamburg, Fed. Rep. of Germany

[21] Appl. No.: 711,346

[22] Filed: Jun. 3, 1991

Related U.S. Application Data

[63] Continuation of Ser. No. 461,864, Jan. 8, 1990, abandoned.

[30] Foreign Application Priority Data

Jan. 17, 1989 [DE] Fed. Rep. of Germany ..... 3901226

[51] Int. Cl.[5] ..... A24D 3/00

[52] U.S. Cl. ..... 131/341; 131/331; 131/194

[58] Field of Search ..... 131/194, 195, 360, 364, 131/336, 338, 341

[56] References Cited

U.S. PATENT DOCUMENTS

| | | | |
|---|---|---|---|
| 3,356,094 | 12/1967 | Ellis | 131/266 |
| 3,614,956 | 10/1971 | Thornton | 131/10.5 |
| 4,219,031 | 8/1980 | Rainer | 131/20 |
| 4,273,141 | 6/1981 | Tilburg | 131/338 X |
| 4,380,241 | 4/1983 | Horsewell | 131/336 |
| 4,386,618 | 6/1983 | Cantrell | 131/336 |
| 4,540,005 | 9/1985 | Cantrell et al. | 131/340 X |
| 4,550,740 | 11/1985 | Riehl, Jr. | 131/341 X |
| 4,874,004 | 10/1989 | Borowski et al. | 131/364 |
| 4,920,990 | 5/1990 | Lawrence et al. | 131/365 X |
| 4,986,287 | 1/1991 | Schneider et al. | 131/336 X |

FOREIGN PATENT DOCUMENTS

| | | |
|---|---|---|
| 3602846 | 8/1986 | Fed. Rep. of Germany . |
| 3743597 | 2/1989 | Fed. Rep. of Germany . |
| 998556 | 5/1945 | France . |
| 1322254 | 10/1982 | France . |
| 1086443 | 10/1967 | United Kingdom . |
| 2070409 | 1/1981 | United Kingdom . |

OTHER PUBLICATIONS

Effect of Cigarette Paper on Smoke Yield and Composition, by Owens, Jr., 32nd Tobacco Chemists Conference in 1978, published in "Recent Advances in Tobacco Science", vol. 4.

The design of Low Yield Cigarettes, by Schur et al, published in a 1960 Volume of "Tobacco Science".

*Primary Examiner*—Theatrice Brown
*Assistant Examiner*—J. Doyle
*Attorney, Agent, or Firm*—Armstrong, Nikaido, Marmelstein, Kubovcik & Murray

[57] ABSTRACT

A coaxial filter cigarette with a rod portion having an inner core of material glowing substantially free of residue, in particular tobacco material, a sheath or wrapper for the inner core, an outer shell of tobacco and/or non-tobacco material coaxially surrounding the inner core or its sheath, respectively, a sheath or wrapper for the outer shell, and with a filter portion having a filter core, an air-impermeable sheath or wrapper for the filter core, a filter shell and a sheath or wrapper for the filter shell comprises a zone of the main heat source which is located in the inner core of the rod portion and a zone in which the major part of the aerosol reaching the mouth of the smoker is produced and which is located in the outer shell of the rod portion; the filter portion greatly reduces the combustion gases originating from the inner core of the rod portion and substantially reduces the smoke particles originating from the inner core, whereas the aerosol produced in the outer shell of the rod portion is influenced only slightly or not at all.

9 Claims, 2 Drawing Sheets

COAXIAL FILTER CIGARETTE

This application is a continuation of application Ser. No. 461,864 filed Jan. 8, 1990 abandoned.

BACKGROUND OF THE INVENTION

1. Field of the Invention

The invention relates to a coaxial filter cigarette comprising a rod portion having an inner core of a material glowing substantially free of residue, in particular tobacco material, a sheath or wrapper for the inner core, an outer shell of a tobacco and/or non-tobacco material coaxially surrounding the inner core or its sheath or wrapper respectively and a sheath or wrapper for the outer shell as well as a filter portion.

2. Description of the Prior Art

A number of publications on so-called "coaxial smokable articles" exists, i.e. in particular coaxial cigars or cigarettes having an inner core which is surrounded by a shell or jacket of tobacco material. The basic principle of such a coaxial cigarette is known, for example, from French Patent Specification No. 998,556; here the inner core consists of tobacco of lower quality which is surrounded by an annular shell of tobacco of high quality. This makes it possible to achieve savings as regards the costs of the tobacco materials used.

Further designs of such coaxial cigarettes are disclosed in French Patent Specification No. 1,322,254, U.S. Pat. Nos. 3,614,956, 4,219,031, British Patent Specification No. 2,070,409, British Patent No. 1,086,443 and German Offenlegungsschrift No. 3,602,846. Furthermore, U.S. Pat. No. 3,356,094 discloses a coaxial cigarette having an inner hollow tube and an aerosol production zone with a narrow outlet; the making of this coaxial cigarette is, however, very complicated and thus expensive; moreover, the various components are separated from each other so that an unusual smoke pattern results.

Finally, a coaxial filter cigarette of the aforementioned type is known from the U.S. Pat. No. 281,640 and comprises a rod portion and a filter portion; the rod portion contains an inner core of a material glowing substantially free of residue, in particular tobacco material, a sheath or wrapper for the inner core, an outer shell of a tobacco and/or non-tobacco material coaxially surrounding the inner core or its sheath or wrapper, respectively, and a sheath or wrapper for the outer core.

The filter portion comprises a filter core, an air-impermeable sheath or wrapper for the filter core, a filter shell and a sheath or wrapper for the filter shell.

The basic principle of this coaxial filter cigarette resides in a distinction in the radial direction between two regions, that is the zone of the main heat source on the one hand and the zone in which the major part of the aerosol reaching the mouth of the smoker is produced on the other hand. The heat generating zone is in the outer shell and the aerosol producing zone is in the inner core of the rod portion.

In such a design of a coaxial filter cigarette the desired reduction of the secondary stream (smoke) is problematical and can be achieved only with great expenditure of time and expense. Moreover, such a coaxial filter cigarette has an inflammatory potential similar to that of a conventional cigarette.

SUMMARY OF THE INVENTION

The invention therefore has as its object the provision of a coaxial filter cigarette of the specified kind in which the aforementioned disadvantages do not occur.

In particular, a coaxial filter cigarette is to be proposed, in which the smoke reaching the mouth of the smoker has a high proportion of flavour-relevant components and a very low proportion of undesirable combustion products; at the same time the secondary stream (smoke) on the one hand and the inflammation potential on the other are to be reduced compared with conventional cigarettes.

For solving these objects, the invention therefore proposes in a coaxial filter cigarette comprising a rod portion having an inner core of a material glowing substantially free of residue, in particular tobacco material, a sheath or wrapper for the inner core, an outer shell of a tobacco and/or nontobacco material coaxially surrounding the inner core or its sheath or wrapper, respectively, and a sheath or wrapper for the outer shell as well as a filter portion, the following improvement: The zone of the main heat source is disposed in the inner core of the rod portion: the zone in which the major proportion of the aerosol reaching the mouth of the smoker is produced in the outer shell of the rod portion, and the filter portion substantially reduces the smoke particles originating from the inner core of the rod portion, whereas the aerosol produced in the outer shell of the rod portion is only slightly influenced or not influenced at all.

Advantageous further developments are defined by the features of the subsidiary claims.

The advantages achieved with the invention are due to the fact that in a coaxial rod the zone of the main heat source on the one hand and the zone in which the greater part of the aerosol reaching the mouth of the smoker on the other hand are specially separated. In contrast to the coaxial filter cigarette according to the U.S. Pat. No. 281,640 the aerosol is produced in the outer shell and the heat in the inner core of the rod portion of the cigarette.

Both the rod portion and the adjoining filter portion, i.e. the materials used therein in conjunction with their specifications determining the flow dynamics, are so designed that a substantial separation of the streams in the outer shell and in the core is ensured.

The filter portion is so constructed that the smoke particles originating from the inner core of the rod portion are substantially reduced, whereas the aerosol produced in the outer shell of the rod portion is only slightly or not at all diminished.

Due to the spatial arrangement of the heat generation in the inner core of the rod portion, the secondary stream (smoke) can be substantially reduced by relatively simple constructional measures because the combustion products are shielded by the outer shell of the rod portion and thus given off largely via the main stream (smoke).

At the same time a reduction of the ignition or inflammation potential of the cigarette is achieved because the heat generation zone is located in the inner core of the rod portion and thus likewise shielded by the outer shell. The temperatures at the surface of the cigarette are thus comparatively low and consequently even on longer contact between the peripheral surface of the cigarette and a combustible material no ignition or inflammation can occur.

If in a filterless coaxial cigarette the heat generation zone were located in the inner core, a high proportion of carbon monoxide (CO) or undesirable smoke components, respectively, would pass from the combustion zone into the mouth of the smoker; in addition, on sealing the end of the inner core of the rod portion, no reaction of the combustion zone would follow after the smoker had taken a draw.

These disadvantages can be avoided by a configuration of the filter portion which is adapted to the configuration of the rod portion and so designed that the smoke particles originating from the inner core of the rod portion are substantially reduced, whereas the aerosol produced in the outer shell of the rod portion is only slightly or not at all influenced.

If the mixture used for the rod portion supplies only amounts of gaseous smoke so small that an additional reduction by ventilation/diffusion is not necessary, a relatively simple coaxial filter element having a suitable sheath or wrapper and an associated tipping paper can be used. The tipping paper can be air-impermeable, porous in nature and/or can be provided with a ventilation zone, which is preferably produced by laser beams and extends in the peripheral direction of the filter portion.

If the tipping paper is porous or preperforated, the sheath paper or wrapper of the single filter element must also be porous. In all other cases, the sheath paper or wrapper may have any desired form.

For most uses, however, such a mouth-side filter element is combined with a rod-side diffusion and ventilation element (passage filter element) to ensure an optimum adaptation to the smoke products and aerosols produced by the rod portion.

Thus, in these cases the diffusion and ventilation element (passage filter element) serves to reduce the gas components which are produced by the combustion occurring in the inner core of the rod portion, whilst the filter element combined therewith traps the smoke particles originating from the inner core of the rod portion and practically does not influence the aerosols produced in the outer shell of the rod portion.

BRIEF DESCRIPTION OF THE DRAWINGS

The invention will be described in detail hereinafter with the aid of examples of embodiment with reference to the attached schematic drawings, wherein:

FIG. 5 is an illustration corresponding to FIG. 2, demonstrating a further embodiment of a coaxial filter cigarette of the invention including an intermediate element.

DESCRIPTION OF THE PREFERRED EMBODIMENTS

Figure 1:
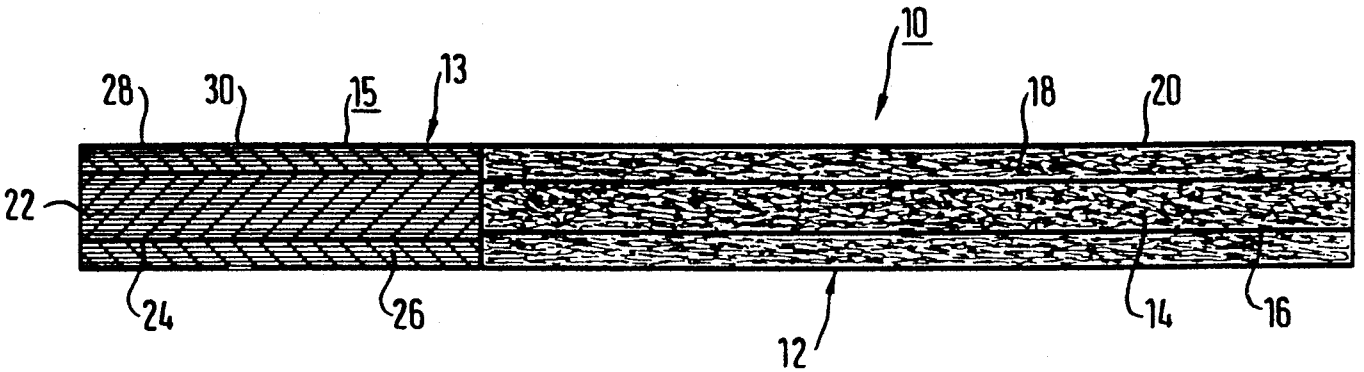
FIG. 1 shows an axial section through a coaxial filter cigarette.

The coaxial filter cigarette shown in FIG. 1 and denoted generally by the reference numeral 10 comprises a rod portion 12 to which a coaxial filter portion 13 is attached by the usual assembly techniques. The rod portion 12 includes an inner core 14 having a sheath or wrapper 16 and an outer shell 18 with a sheath or wrapper 20.

In the embodiment according to FIG. 1 the filter portion 13 comprises a single coaxial filter element 15 with a filter core 22 having a sheath or wrapper 24 and with a filter shell 26 having sheath or wrapper 28.

The coaxial filter element 15 can be ventilated as will be explained below; the ventilation means is indicated by a line of punctiform ventilation openings or holes 30 which extend over the periphery of the coaxial filter element 15, as well as through the tipping paper (not shown).

The coaxial rod portion serves for smoke and vapour generation and has a length of 25 to 85 mm and a diameter of 7 to 9 mm, i.e. the usual dimensions of conventional cigarettes.

The inner core 14 of the rod portion 12 has a diameter of 2 to 6 mm and consists of tobacco or another allowable material which decomposes under the action of heat. Additives for controlling the combustion are added to the material of the inner core 14 and ensure that the heat generation zone of the rod portion 12 is located in the inner core 14.

The air-impermeable sheath 16 of the inner core 14 of the rod portion 12 consists of paper, a foil of tobacco material or another suitable air-impermeable material and comprises at least one passage, 14*a*, for sucking air into the interior of the inner core 14 in order in this manner to control the combustion in the heat generating zone in the inner core 14. In accordance with the desired draw number, the air suction passage(s) must extend from the ignition side at least over a part of the length of the rod portion 12.

Various alternatives are available for implementing said air suction passage; the inner core 14 may, for example, be formed by an extrudate or a compact with impressed channels as alternative, the material of the inner core 14 may be formed as open-pore body., also, the sheath 16 of the inner core 14 can be made double-walled with continuous inner passages; finally, the sheath 16 of the inner core 14 of the rod portion 12 can contain rod-like bulges as spacers at the inner side.

The sheath 16 of the inner core 14 may be embossed, corrugated or grooved so that free flow passages are formed in the longitudinal direction of the coaxial filter cigarette 10.

The outer shell 18 of the rod portion 12 consists of tobacco, other materials made from tobacco, materials decomposing under the action of heat (and/or of materials which are thermally stable at temperatures up to 500° or 600° C.) which can be crumbled under mechanical action, and/or of combinations of such materials, and contains additives for controlling the thermal processes and the combination of aromatics and flavourings, referred to as "casing", which is generally present in solutions and contain sugar, moistening agents and similar substances.

Both the additives for controlling the thermal processes and the casing materials are preferably present in high concentration, i.e. in total concentrations of more than 5% with respect to the material weight of the outer shell 18 of the rod portion 12.

Alternatively or additionally, the outer shell 18 may contain further materials which on being heated to a temperature of about 500° C. are largely transferred into the vapour and/or aerosol state without undesirable components being released.

The outer sheath 20 of the outer shell 18 of the rod portion 12 is either air-impermeable or has a very low air permeability of less than 25 ISO units; it consists of a cigarette paper, preferably with a heat-insulating coating, or of a heat-insulating material; it also contains additives for controlling the combustion.

The outer sheath 20 of the outer shell 18 of the rod portion 12 may possibly be provided with segment perforations for controlling the temperature gradients in the outer shell 18; the use and/or the configuration of these segment perforations depends on the other materials employed.

If the mixture in the rod portion 12 furnishes such small amounts of smoke gas that an additional reduction of the amounts of gaseous smoke by ventilation/diffusion is not necessary, the filter portion 13 can consist (see the embodiment in FIG. 1) of a single coaxial filter element 15 having an outer diameter which corresponds to the outer diameter of the rod portion 12, i.e. is about 7 to 9 mm. The length of said single coaxial filter element 15 lies in the range from 10 to 40 mm.

The diameter of the filter core 22 lies in the range from 2 to 6 mm, i e. corresponds substantially to the diameter of the inner core 14 of the rod portion 12 in accordance with a preferred embodiment said diameter is about 2 mm larger than the diameter of the inner core 14.

The filter efficiency of the filter core 22 should be more than 95% of the smoke streaming into the filter core 22. The filter core 22 may consist of the usual filter materials, preferably cellulose acetate.

The sheath of the filter core 22 is air-impermeable and may consist of paper, polyethylene or preferably also cellulose acetate.

The filter shell 26 has a filter efficiency of 0 to 60% for the smoke entering the filter shell 26, in particular a filter efficiency of 10 to 30%, and may consist of the known filter materials but also of tobacco.

According to a preferred embodiment the filter shell 26 is made from cellulose acetate.

If only the coaxial filter element 15 is used, a suitable sheath 28 is employed in combination with a tipping paper which is air-impermeable, porous and/or is provided with a ventilation zone 30 preferably produced with laser beams and extending in the peripheral direction.

The sheath or wrapper 28 of the filter shell 26, generally a paper wrapper, must be porous as well only when the tipping paper serving to attach the filter element 15 to the rod portion 12 is porous or preperforated. In all other cases the air permeability of the sheath 28 of the filter shell 26 may be selected as desired.

Figure 2:
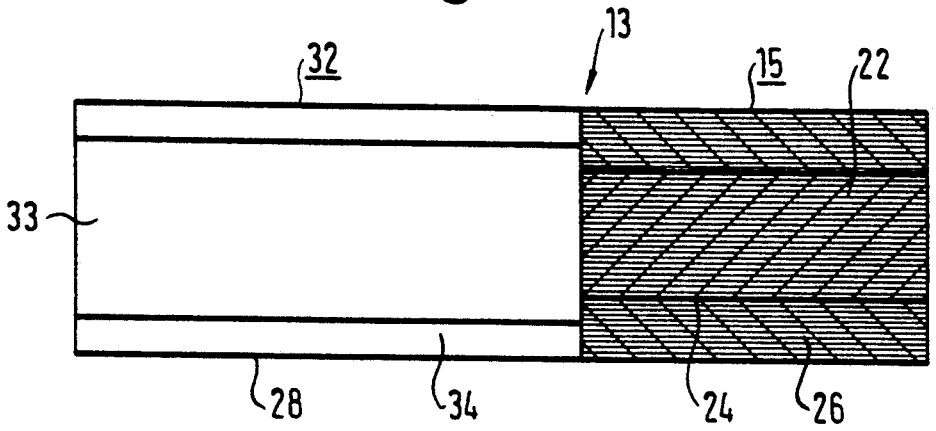
FIG. 2 is a illustration corresponding to FIG. 1 of a further embodiment of the filter portion of such a coaxial filter cigarette.

However, as a rule the mixture in the rod portion 12 produces such large amounts of gaseous smoke that the coaxial filter element 15 alone is not sufficient; in such a case the embodiment according to FIG. 2 may be employed, in which the filter element 15 is combined with the structure explained above and having a rod-side diffusion and ventilation element 32. In this case, the air permeability of the sheath 28 of the outer shell 26 of the filter portion 15 may be selected as desired., the sheath 28 may either be provided with an air-impermeable tipping paper or the same tipping paper as in the diffusion and ventilation element 32 (still to be explained) may be used; in the first case two different tipping papers are necessary for the two filter elements, whilst in the second case a single unitary tipping paper may be employed for the entire filter portion 13.

The rod-side diffusion and ventilation element 32 has a length of 10 to 40 mm and a diameter which corresponds to the diameter of the outer shell 18 of the rod portion 12, i.e. lies in the range from about 7 to 9 mm.

The diffusion and ventilation element 32 may be formed as fibre filter having the lowest packing density which can still be processed or as hollow element of a plastic material., in FIG. 2 such a hollow element 32 with a cavity 33 is indicated. The hollow element 32 may contain usual chamber filter materials or other pourable or granulate material which is suitable for reducing the components of the gas phase of the resulting smoke.

When an air-impermeable material is used to make the hollow element 32, the outer surface of said hollow element 32 must have an adequate number of perforations; the total perforation area must be at least 10% of the outer area of the hollow element 32; the walls of outer passages 34 (still to be explained) in any case must be impermeable and not perforated.

Figure 3:
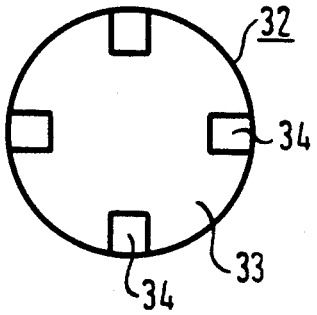
FIG. 3 is a section through the rod-side diffusion and ventilation element of the filter portion according to FIG. 2 and FIG. 4 in an illustration corresponding to FIG. 1 of a further embodiment of the filter portion.

In the ventilation and diffusion element 32 at least four outer passages 34 are provided which on their inside are air-impermeable and have a rectangular form, the longer side of the rectangle is perpendicular to the outer surface of the ventilation and diffusion element 32 as can be seen in FIG. 3.

The decisive criterion for the shape of the outer passages 34 is as great as possible a cross-sectional area with as small as possible a proportion of the outer surface of the element 32.

The radial depth of the passages 34 must not be larger than the radius of the outer shell 18 of the rod portion 12 minus the radius of the inner core 14 of the rod portion 12.

The mouth-side end face of the hollow element 32, i.e. the end face directed towards the filter element 15, is configured so that the stream from the outer passages 34 is conducted into the filter shell 26 of the adjacent coaxial filter element 15, whereas the stream from the cavity of the hollow element 32 is conducted into the filter core 22 of the adjoining filter element 15.

In a possible realisation of the described embodiment, the ventilation and diffusion element 32 and in particular its separation function between the filter element 15 and the rod portion 12 can be implemented by a corresponding partial sealing of the mouth-side end face of the filter element 32, for example, by using a specially shaped filter element with a diaphragm, as is known fundamentally from German Patent Specification No. 3,400,004, or by using an additional intermediate element (not shown in FIG. 2) having the following properties:

The intermediate element has a length of 3 to 7 mm, a diameter corresponding to the outer diameter of the filter element 15, outer passages corresponding to the outer passages 34 of the hollow element 32, and a hollow inner tube having a diameter which is at least 1 mm smaller than the diameter of the filter core 22 of the filter element 15. This intermediate element must consist of an air-impermeable material.

The sheath or wrapper 28 of the hollow element 32 has a very high air-permeability of at least 10000 ISO units; this desired high air permeability can be achieved also if no sheath 28 at all is employed.

For attaching the filter portion 13 to the rod portion 12, a tipping paper of low air permeability in the range from 20 to 150 ISO units is used and should at the same time ensure a high diffusion of gases with low molecular weight (e.g. CO).

If desired, the filter portion 13 according to FIG. 2 may also be provided with a ventilation zone 30 which is spaced about 2 to 5 mm from the mouth-side end of the element 32 and ensures that the filter portion 13 has a ventilation degree of 5 to 80%.

Figure 4:
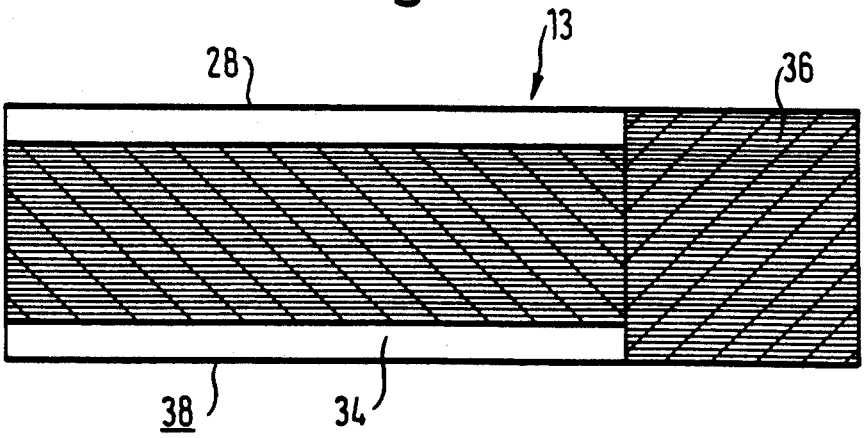

FIG. 4 shows a further embodiment of the filter portion 13 which consists in this case of a mouth-side filter element 36 and a rod-side passage filter element 38.

The mouth-side filter element 36 has a length of 6 to 24 mm, a diameter of 7 to 9 mm corresponding to the diameter of the rod portion 12, and consists of a material having the usual filter properties, preferably cellulose acetate.

The filter material of the filter element 36 has a specific draw resistance of preferably less than 150 Pa/cm.

If the filter element 36 is longer than 10 mm a ventilation zone 30 may be provided, ensuring a ventilation degree of 5 to 80%. The ventilation zone should be spaced at least 10 mm from the mouth-side end of the filter element 36 and thus of the filter portion 13 to ensure that the lips of the smoker cannot close the ventilation perforations.

The rod-side passage filter element 38 has a length of 10 to 34 mm and comprises likewise outer passages 34, as are provided in the embodiment according to FIG. 2.

The sheath 28 and the tipping paper (not illustrated) of the filter element 13 also have the properties described with respect to the embodiment shown in FIG. 2.

The rod-side passage filter element 38 is filled with the usual filter materials; especially cellulose acetate, the specifications of which are selected in dependece upon the length of the passage filter element 38 in such a manner that the smoke particles given off from the inner core 14 of the rod portion 12 are filtered to at least 95%.

We claim:

1. A coaxial filter cigarette comprising:

a rod portion defined by an outer wrapper;

an inner core disposed coaxially within said rod portion defined by a coaxially disposed inner wrapper;

a main heat source disposed within said inner core, said main heat source is a material which glows substantially residue-free;

an outer shell defined by a space created between the outer wrapper and said inner wrapper, said outer shell being filled with an aerosol producing material consisting of at least one of the group consisting of tobacco and non-tobacco materials;

additives for controlling combustion intermixed with said main heat source;

a filter portion disposed at one end of the rod portion, with a single coaxial filter element having a filter core with an air impermeable wrapper and a filter shell;

said filter core removing greater than 95% of smoke received into said filter core generated through combustion of said rod portion, and said filter shell removing a maximum of 60% of said smoke flowing into said filter shell.

2. A coaxial filter cigarette according to claim 1, wherein said wrapper of the inner core of the rod portion is air-impermeable but has at least one passage for sucking air into the inner core.

3. A coaxial filter cigarette according to claim 1, wherein said outer shell of the rod portion contains additives for controlling the thermal processes.

4. A coaxial filter cigarette according to claim 1, wherein said wrapper of the outer shell of the rod portion has a very low air permeability of at the most 25 ISO units.

5. A coaxial filter cigarette according to claim 1, wherein said wrapper of the outer shell of the rod portion contains additives for controlling the combustion.

6. A coaxial filter cigarette according to claim 1, wherein a rod-side diffusion and ventilation element having a wrapper with outer passages is disposed between said coaxial filter element and the rod portion.

7. A coaxial filter cigarette according to claim 6, wherein the filter portion comprises a further intermediate element having outer passages and a hollow inner tube, the diameter of which is at least 1 mm smaller than the diameter of the filter core.

8. A coaxial filter cigarette according to claim 6, wherein said wrapper of said the diffusion and ventilation element has is air permeable.

9. A coaxial filter cigarette according to claim 1, wherein said filter shell removes 10–30% of said smoke flowing into said filter shell.

* * * * *